US006389820B1

(12) United States Patent
Rogers et al.

(10) Patent No.: US 6,389,820 B1
(45) Date of Patent: May 21, 2002

(54) SURFACTANT PROCESS FOR PROMOTING GAS HYDRATE FORMATION AND APPLICATION OF THE SAME

(75) Inventors: Rudy E. Rogers, Starkville; Yu Zhong, Brandon, both of MS (US)

(73) Assignee: Mississippi State University, Mississippi State, MI (US)

( * ) Notice: Subject to any disclaimer, the term of this patent is extended or adjusted under 35 U.S.C. 154(b) by 0 days.

(21) Appl. No.: 09/501,766

(22) Filed: Feb. 10, 2000

Related U.S. Application Data

(60) Provisional application No. 60/119,824, filed on Feb. 12, 1999.

(51) Int. Cl.[7] ..... F17C 3/00
(52) U.S. Cl. ..... 62/45.1
(58) Field of Search ..... 62/47.1, 46.1, 62/45.1

(56) References Cited

U.S. PATENT DOCUMENTS

| | | | |
|---|---|---|---|
| 4,540,501 A | 9/1985 | Ternes et al. | 252/70 |
| 5,540,190 A | 7/1996 | Rogers et al. | 123/1 A |
| 5,841,010 A | 11/1998 | Rabeony et al. | 585/3 |

OTHER PUBLICATIONS

Kalogerakis et al., SPE 25188; International Symposium on Oilfield Chemistry:"Effect of Surfactants on Hydrate Formation Kinetics"; New Orleans, LA, Mar. 2–5, 1993; pp. 375–383.

A. D. MacKerell, Jr. J. Phys. Chem. 99: "Molecular Dynamics Simulation Analysis of a Sodium Dodecyl Sulfate Micelle in Aqueous Solution: Decreased Fluidity of the Micelle in Aqueous Solution: Decreased Fluidity of the Micelle Hydrocardon Interior"; 1995; pp. 1846–1855.

H. Narita, T. Uchida, 2nd International Symposium on Gas Hydrates , Toulouse, France, "Studies on Formation/Dissociation Rates of Methane Hydrates"; pp. 191–197.

A. Vysniauskas et al, Chemical Engineering Science 40;"Kinetics of Ethane Hydrate Formation"; 1985; pp. 299–303.

E. Wanless, W. Ducker, J. Phys. Chem. 100; "Organization of Sodium Dodecyl Sulfate at the Graphite–Solution Interface"; 1996; pp. 3207–3214.

G. Yevi et al; Journal of Energy Resources Technology 118; "Storage of Fuel in Hydrates for Natural Gas Vehicles (NGVs)"; 1996, pp. 209–213.

(List continued on next page.)

*Primary Examiner*—William Doerrler
*Assistant Examiner*—Malik N. Drake
(74) *Attorney, Agent, or Firm*—Steven B. Kelber; Piper Marbury Rudnick & Wolfe, LLP

(57) ABSTRACT

This invention relates to a method of storing gas using gas hydrates comprising forming gas hydrates in the presence of a water-surfactant solution that comprises water and surfactant. The addition of minor amounts of surfactant increases the gas hydrate formation rate, increases packing density of the solid hydrate mass and simplifies the formation-storage-decomposition process of gas hydrates. The minor amounts of surfactant also enhance the potential of gas hydrates for industrial storage applications.

33 Claims, 8 Drawing Sheets-

OTHER PUBLICATIONS

Jeneil Biosurfactant Company—Product Sheet: "Biosurfactant–Rhamnolipids"; 1999; pp. 1–4.

D. Herman et al.; Environmental Science & Technology, vol. 29, No. 9; "Removal of Cadmium, Lead, and Zinc From Soil by a Rhamnolipid Biosurfactant"; 1995; pp. 2280–2285.

R.A. Goodnow et al.; Applied and Environmental Microbiology, vol. 56, No. 7, "Fate of Ice Nucleation–Active *Pseudomonas syringae* Strains in Alpine Soils and Waters and in Synthetic Snow Samples"; 1990; pp. 2223–2227.

D.L. Glutnick; Biopolymers, vol. 26, "The Emulsan Polymer: Perspectives on a Microbial Capsule as an Industrial Product"; 1987; pp.S223–S240.

T. Collett, 2$^{nd}$ International Symposium on Gas Hydrates, Toulouse, France, "Geologic Assessment of the Natural Gas Resources in the Onshore and Offshore Regions of the United States"; 1996; pp. 499–506.

P. Englezos, 2$^{nd}$ International Symposium on Gas Hydrates, Toulouse, France, "Nucleation and Growth of Gas Hydrate Crystals in Relation to 'Kinetic Inhibition'"; 1996; pp 147–153.

J. Herri et al, 2$^{nd}$ International Symposium on Gas Hydrates, Toulouse, France, "Kinetics of Methane Hydrate Formation"; 1996; pp 243–250.

Y. Mori et al, 2$^{nd}$ International Symposium on Gas Hydrates, Toulouse, France, "Modeling of Mass Transport Across a Hydrate Layer Intervening Between Liquid Water and "Guest" Fluid Phases"; 1996; pp 267–274.

M. J. Rosen; "Surfactants and Interfacial Phenomena"; 1978; pp 83–122.

J. D. Rouse et al, Environmental Science Technology 29, "Micellar Solubilization of Unsaturated Hydrocarbon Concentrations as Evaluated by Semiequilibrium Dialysis"; 1995; pp 2484–2489.

S. Thangamani et al, Environmental Science Technology 28, "Effect of Anionic Biosurfactant on Hexadecane Partitioning in Multiphase Systems"; 1994; pp 1993–2000.

E. D. Sloan, Jr., "Clathrate Hydrates of Natural Gas"; pp 24–110.

A. Vysniauskas et al, Chemical Engineering Science 38;"A Kinetic Study of Methane Hydrate Formation"; 1983; pp. 1061–1972.

R. E. Rogers, Contact DE–AC26–97FT33203, "Natural Gas Hydrates Storage Project"; 1999; pp 1–49.

R. E. Rogers, Contact DE–AC26–97FT33203, "Natural Gas Hydrates Storage Project Phase II. Conceptual Design and Ecomomic Study"; 1999; pp 1–34.

SURFACTANT PROCESS FOR PROMOTING GAS HYDRATE FORMATION AND APPLICATION OF THE SAME

This application is a regular National application claiming priority from Provisional Application, U.S. Application Serial No. 60/119,824 filed Feb. 12, 1999. The entirety of that provisional application is incorporated herein by reference.

This invention was made with U.S. Government support under contract number DE-AC26-97FT33203 awarded by the Department of Energy. The U.S. Government may have certain rights in this invention.

BACKGROUND OF THE INVENTION

Field of the Invention

The present invention relates to a process and a composition for promoting gas hydrate formation. The invention also relates to a process for storing gas using gas hydrates. This invention was developed as a result of a contract with the United States Department of Energy.

DISCUSSION OF THE BACKGROUND

Current means of storing natural gas (i.e., gas compositions constituted primarily of methane but that may contain minor amounts of other components such as ethane, propane, isobutane, butane, and/or nitrogen) or any of its components include, for example, compressed gas storage, liquified gas storage, underground storage, and adsorption. Each of these means of storage, however, have undesirable deficiencies. For example, liquified gas storage involves high costs and hazards such as the possibility of the gas tank rupturing. Underground storage of natural gas is limited to the regions of the country with satisfactory geological features such as porous sandstone formations and salt domes. Such geographical features are not usually found in most populous regions where the demand for natural gas is greatest; therefore, the gas must be stored where these geographical features are found and then shipped to where it is needed. Compressed gas storage, like liquified gas storage, involves high costs and hazards primarily because of the high pressures involved in storing gas in this manner.

A search for alternative methods of storing natural gases has led to the consideration of clathrates. Clathrates are distinguished by having molecules of one type completely enclosed within the crystalline structure of molecules of another type. Gas hydrates are a subset of the class of the solid compounds called clathrates. Gas hydrates are crystalline inclusion compounds formed when water and gas are mixed under conditions of elevated pressure and reduced temperatures. Through hydrogen bonding, the host water molecules form a lattice structure resembling a cage. For gas hydrates, a guest molecule such as, for example, natural gas and its components, is contained within the cage-like crystalline structure of the host water molecule.

Utilizing gas hydrates as a means to store natural gas or its components has not been practical because of numerous deficiencies. First, the formation of hydrates in a quiescent system is extremely slow at hydrate-forming temperatures and pressures. The typical mechanism of hydrate formation in a quiescent pure water-gas system is as follows: water molecules first form clusters by hydrogen bonding in the liquid phase, proceeding to cluster and occlude gas until a critical concentration and size of the clusters is reached. This is the critical nuclei for hydrate formation. After an induction time of about 20 minutes, depending upon system conditions (i.e., temperature and pressure), particle agglomeration of these nuclei proceeds at the water-gas interface, resulting in the formation of a thin film of hydrates on the surface that isolates the water from the gas, thereby drastically slowing the rate of hydrate formation because the water and the gas must then diffuse through the thin film to perpetuate hydrate growth. Attempts to improve hydrate formation rate in a quiescent system include both a "rocking cell" apparatus in which the rocking motion establishes enough turbulence to periodically sweep away the hydrate film that forms on the water surface preventing contact with the gas and mechanical stirring to generate renewed surface area of the water in contact with the gas. The generation of renewed surface area via a rocking motion or mechanical stirring is necessary for rapid hydrate formation because otherwise the thin film of hydrates on the surface of the water isolates the gas from the water. This decreases the rate of gas absorption into the free water and drastically slows the formation of hydrates.

Another deficiency in establishing a practical means of gas storage using hydrates results from the entrapment of free water (i.e., water not bound in hydrate form) between hydrate particles. The solid mass of hydrates includes a large amount of water entrapped between hydrate particles and isolated from the gas. Typically, more water is trapped between solid hydrate particles than is bound in the hydrate structure. The appreciable volume of storage space occupied by this entrapped interstitial water means that much of the storage space is occupied by water not containing gas. The entrapment of free water between solid hydrate particles has been a deterrent to practical use of hydrates because the result is inefficient packing of the gas which, in turn, results in a low storage capacity for the gas. Even when the hydrates are created by mechanical stirring, the entrapped water still represents a large percentage of the volume.

Yet another deficiency in using hydrates for storing gas is the complexity of the hydrate formation-storage-decomposition process. Typically, a water-hydrate slurry forms as the hydrates develop. The thickness of the slurry makes mechanical stirring difficult. Also, the hydrate particles grow in a random pattern within a formation vessel and must be removed from the slurry and packed in a separate container for storage. This separation and packaging step requires an often difficult and economically unfeasible mechanical process.

In view of the aforementioned deficiencies attendant with the prior art methods, it is clear that there exists a need in the art for practical methods of utilizing hydrates as a means of storing gas and for the corresponding compositions.

SUMMARY OF THE INVENTION

Accordingly, one object of this invention is to provide a practical and economically-viable means for storing gases such as, for example, natural gas and its components, using hydrates.

Another object of the invention is to simplify the process of gas hydrate formation and storage.

To achieve the foregoing and other objects, and in accordance with the purpose of the present invention as embodied and broadly described herein, there is provided a method of storing gas comprising forming gas hydrates in the presence of a water-surfactant solution.

To further achieve the foregoing and other objects, this invention is also directed to a composition for promoting gas hydrate formation comprising a mixture of water, an effective amount of a surfactant and at least one hydrate-forming constituent.

BRIEF DESCRIPTION OF THE DRAWINGS

A more complete appreciation of the invention and many of the attendant advantages thereof will be readily obtained as the same become better understood by reference to the following detailed description and appended claims when considered in connection with the accompanying drawings, wherein:

DESCRIPTION OF THE PREFERRED EMBODIMENTS

Figure 1:
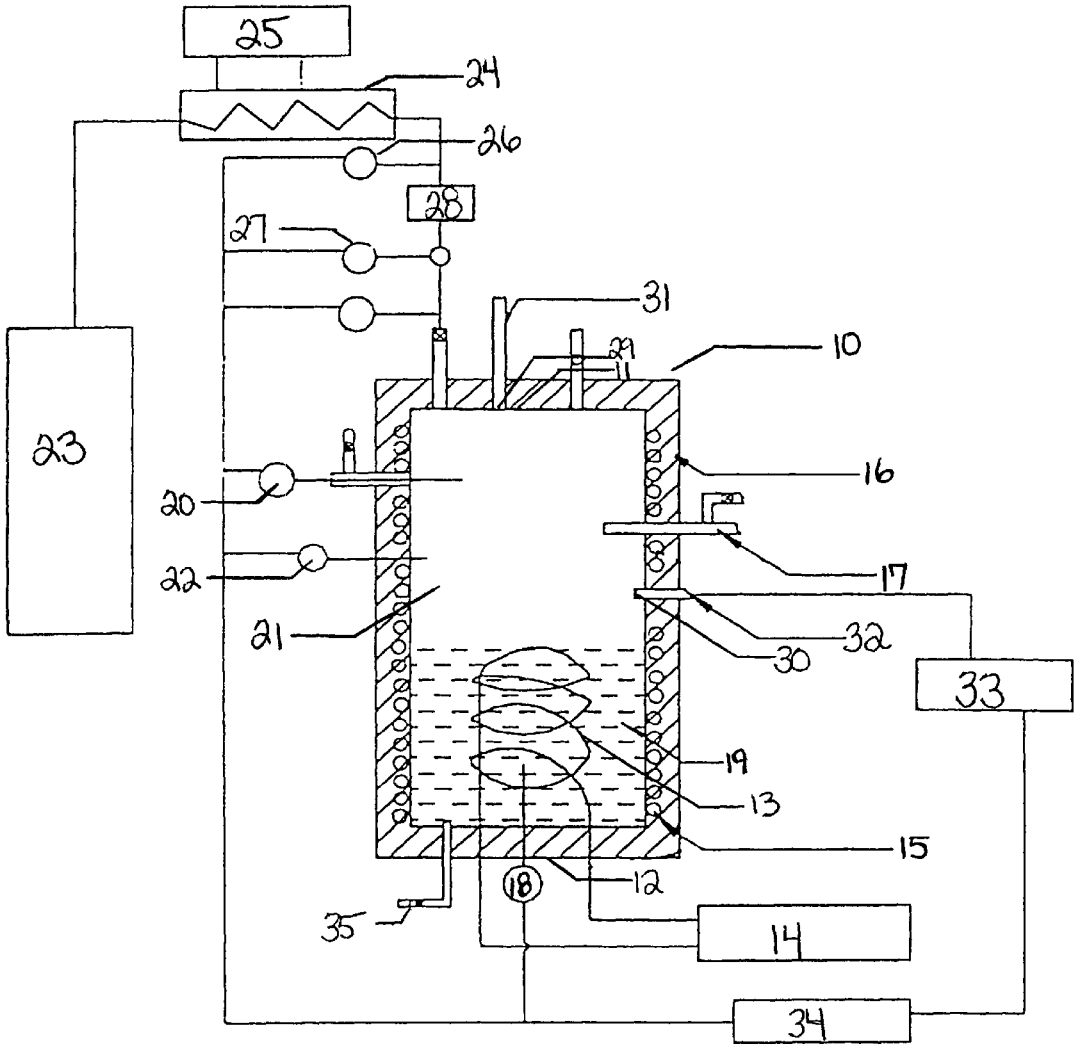
FIG. 1 is a schematic drawing of the apparatus used in the present invention.

As used herein, the term "biosurfactant" refers to a particular group of surfactants, namely microbially produced surfactants.

It has now been found that the addition of minor amounts of surfactant to a water-gas system provides an enhanced means of storing natural gas, or any of its components, aboveground in a safe and economic manner. The present invention promotes the formation of hydrates in a liquid containing hydrate-forming constituents such as, for example, natural gas and its components. The phrases "formation of hydrates" and "hydrate formation" refer to the nucleation, growth and/or agglomeration of hydrates. The present invention also simplifies the process of hydrate formation in a quiescent system, greatly improves the gas packing fraction to yield high storage capacity and provides an improved means of collecting and packing hydrate particles.

In the process of the present invention, surfactant is added to water at concentrations at or above the critical micelle concentration to affect gas hydrate formation in the presence of hydrate-forming gases at temperatures and pressures known to create hydrates for the purpose of utilizing the storage property of gas hydrates in industrial, commercial, residential, transportation, electric-power generation, and other similar applications. The critical micelle concentration refers to a threshold level of surfactant concentration necessary for micelles to form. A micelle is an accumulation of the surfactant molecules in the water as colloidal aggregates in a definite geometric shape. While not being bound to any particular theory, it is believed that by solubilizing the gas as a consequence of the surfactant and its micelles, the gas is brought into intimate contact with the water host and the surfactant micelles interact with hydrate crystal nuclei to facilitate hydrate formation to such a great extent as to make gas hydrate storage practical for large-scale, industrial applications.

Any surfactant, including biosurfactants, that solubilizes the particular gas used and that adsorbs on metal may be suitable for use in the present invention. Generally, the surfactant used in the present invention is selected from the group consisting of anionic surfactants and biosurfactants and mixtures thereof. Most anionic surfactants can be broadly described as the water-soluble salts, particularly the alkali metal, alkaline earth metal, ammonium and ammine salts of organic sulfuric reaction products having in their molecular structure an alkyl radical containing from about 8 to about 22 carbon atoms and a sulfonic acid radical. In particular, the anionic surfactants useful in the present invention are alkyl sulfates, alkyl ether sulfates, alkyl sulfonates and alkyl aryl sulfonates having an alkyl chain length of from about 8 to about 18 carbon atoms. The alkyl sulfates and alkyl aryl sulfonates are the preferred anionic surfactants. In accordance with the preferred embodiments of the present invention, the anionic surfactant is selected from the group consisting of sodium lauryl sulfate and sodium benzene dodecyl sulfate. Most preferred as the anionic surfactant is sodium lauryl sulfate.

The quantity of surfactant added to the water will be an effective amount that promotes hydrate formation. The minimum effective amount of surfactant is the critical micelle concentration of the particular surfactant used. It should be noted that the critical micelle concentration changes with respect to the particular gas and the particular surfactant present in the water-surfactant-gas system of the present invention. Preferably, the surfactant will be added in amounts ranging from about 200 ppm to about 1200 ppm, more preferably from about 240 ppm to about 1120 ppm. Ranges outside the above ranges are contemplated so long as the surfactant promotes hydrate formation.

The present invention can be applied to any gas-water mixture where hydrates can form. Some hydrate-forming hydrocarbons include, but are not limited to, methane, ethane, propane, butane, isobutane, neopentane, ethylene, propylene, isobutylene, cyclopropane, cyclobutane, cyclopentane, cyclohexane, benzene and mixtures thereof. Some hydrate-forming non-hydrocarbons include, but are not limited to, carbon dioxide, sulfur dioxide, nitrogen oxides, hydrogen sulfide and mixtures thereof. Preferably, the present invention will be applied to natural gas and/or its components.

FIG. 1 is a schematic drawing o the experimental apparatus used in the present invention. Test cell 10 has a capacity of about 3800 $cm^3$. The test cell is made of stainless steel or other metal. Both ends 11, 12 are sealed with blank flanges (not shown) bolted to test cell 10. The flanges have phonographic serrated raised faces (not shown) with 0.79 mm concentric grooves (not shown) to accommodate sealing with 2.4 mm thick Teflon® gaskets (not shown). Each blank flange has approximate ports for access to the interior; additional ports exist along the sides of test cell 10. Inside the lower half of test cell 10 is coil 13 of about 9.5 mm diameter 316 ss tubing through which is circulated cooling water with enough ethylene glycol to depress the water's freezing point to about 253 K. The coolant is circulated from refrigerated bath 14 capable of maintaining bath temperature within about ±0.01 K of the set point to a low temperature capability of about 253 K. Around the exterior of test cell 10 is coiled about 9.5 mm stainless steel tubing 15 through which the coolant is also circulated. Test cell 10 and cooling coils 15 are enclosed with insulation 16. Ultrasonic probe 17, which can also be used as an atomizer, extends into test cell 10 from a side port. First temperature probe 18 extends into water-surfactant solution 19 at the bottom of test cell 10.

Second temperature probe 20 extends into gas phase 21 at the top of test cell 10. Pressure transducer 22 extends into test cell 10 from a side port. Gas is supplied to test cell 10 from compressed gas supply 23 through feed reservoir 24. Coolant bath 25 precools the gas added to test cell 10 while the gas resides in feed reservoir 24. If the pressure is high enough, the gas cools because of the Jules-Thomson effect and coolant bath 25 is not used to cool the gas as it passes through feed reservoir 24 and into test cell 10. Second pressure transducer 26 monitors pressure in feed reservoir vessel 24. A piston metering pump (not shown) with a maximum pressure capability of about 5.52 MPa and a flow rate of about 31 ml/min allows metering water solutions into the cell under pressure.

Mass gas flow meter 27 is used to measure gas added to test cell 10 during hydrate formation, while constant pressure regulator 28 is used to maintain constant pressure in test cell 10 within about ±6.9 kPa.

The interior of test cell 10 is viewed during operation in one of two ways. One way is to view the interior or to take still camera photographs through a 101.6 mm diameter×50.8 mm thick quartz window (not shown) secured in a blind flange bolted to the top of test cell. A second way is that depicted in FIG. 1. Two 9.5 mm (inner diameter) viewing-wells 29, 30 extend into test cell 10 from the top and the side of test cell 10, respectively. Viewing wells 29, 30 are sealed with transparent sapphire windows (not shown) pressure checked to about 16 MPa. Well 29 allows light input from a 150 watt halogen light source 31 transmitted by fiber optics light guide. Well 30 accommodates black and white video camera 32 where the image is transmitted to either video cassette recorder and television monitor 33 for taping and/or viewing while running or directly to computer 34 for digital processing. Hydrate formnation may be followed by the temperatures, pressures and mass flows displayed and recorded on computer 34. The viewing system depicted in FIG. 1 was supplied by Instrument Technology, Inc.

In the process according to the present invention, water and surfactant are mixed to form a water-surfactant solution, and this water-surfactant solution is pumped into an empty cell to displace any gas in the cell. Gas is then injected under pressure into the cell to displace the water-surfactant solution to a predetermined level. Enough gas is injected to bring the pressure of the system to the desired initial pressure. The temperature is adjusted to a level at which hydrate particles can form by circulating coolant through the cooling coils to decrease the temperature to the desired operating temperature. While the operating conditions will vary according to the particular water-surfactant-gas system, the temperature generally ranges from about 30° F. to about 50° F., and the pressure is generally below about 700 psi.

At the appropriate pressure and temperature, hydrate particles begin to form. The present invention allows the hydrate formation process to proceed in a quiescent water solution. The presence of surfactant also increases the rate of hydrate formation, even in a quiescent system. The presence of surfactant, therefore, eliminates the need for moving parts and other means of artificial motion during hydrate formation. While not wishing to be bound, it is believed that the presence of surfactant affects the mechanism for hydrate formation such that hydrate particles form subsurface, even in a quiescent system, as a result of the action of the surfactant micelles in bringing the gas and water together. In other words, the gas is brought into intimate contact with the surrounding water, and the micelles act as nucleation sites congregating the water-cluster precursors of hydrates at the surface of the micelle sphere. These sites are located subsurface, as well as on the surface of the water. With surfactant present, hydrate particles form below the water surface. The subsurface hydrate-formation phenomenon in the presence of surfactant is attributed to the presence of the micelles. After hydrate particle formation, the subsurface hydrate particles move rapidly to the walls of the container to be adsorbed on that solid surface. Surfactant adsorption at solid-liquid-gas interfaces is common with the micelle structure intact. The cylindrical mass buildup of hydrate particles on the surfactant-wetted walls continue as the water level in the cell drops. The boost to gas solubility by micelles and the subsurface migration of the hydrate particles to be adsorbed on the walls account for a significant increase in hydrate formation rate when surfactant is present.

With surfactant present, the hydrate particles utilize the entrapped interstitial water by converting it to hydrate particles. The interstitial water contains surfactant excluded from the hydrate structure, which concentrates in the interstitial water to promote continued hydrate formation as the interstitial water forms hydrates. Free water trapped between hydrate particles on the cell walls continues to form hydrates because the surfactant is excluded from the hydrate structure and is transferred to the surrounding water. Because the surfactant in the interstitial water keeps the reaction going to solid hydrate, the interstitial water is fully utilized to give a solid hydrate mass having a high bulk density. Thus, the presence of surfactant maximizes the gas content of the packed hydrate particles, as entrapped free water between packed particles continues to form hydrates after adsorption onto the cell walls until complete utilization of entrapped water is approached. The hydrate mass ultimately contains a high fraction of utilized space. Theoretically, the utilization of the water can approach 100 percent. The conversion of interstitial water into hydrate particles enhances the prospects of utilizing hydrates for gas storage because the solid hydrate particle mass contains minimal amounts of unreacted free water.

An important simplification that results from the use of surfactant is that the surfactant facilitates the packing of hydrate particles on the wall of the container as they form. In the presence of surfactant, the hydrate particles migrate to the walls and self-pack in a desired arrangement, building inwardly from the walls in a concentric cylinder. Upon depletion of the water (i.e., completion of hydrate formation), a solid hydrate mass protrudes inwardly from the cell walls. This improves the practicality of the hydrate storage process of the prior art because in the prior art a slurry of hydrate particles resulted, which would require additional processing to collect. With surfactant present, an expensive processing step of removing particles from the water slurry and packing them in a separate storage container is avoided. Furthermore, space is maximized when the surfactant-laden particles build inwardly from the container walls toward the center of the container.

In the presence of surfactant, hydrate formation, storage and decomposition may be accomplished in a single vessel. Furthermore, the presence of surfactant also allows for reuse of the water-surfactant solution. After decomposition of the hydrate particles (i.e., use of the gas stored in the hydrate particles), the water and surfactant remain in the container. The next hydrate formation cycle proceeds simply by repressurizing the container with gas.

The invention will now be described by reference to the following detailed examples. The examples are set forth by way of illustration and are not intended to be limiting in scope.

EXAMPLES

Sodium dodecyl sulfate (molecular weight about 288.4 g/mole) purchased from Strem Chemicals, Inc. is used in the following examples. The sodium dodecyl sulfate is in powder form and is 98+ percent pure with no alcohols in the residue.

Two types of gas are used in the following examples. One is ethane gas having an ethane purity of about 99.6 percent purchased from Matheson Gas Products. The second is a primary as mixture of about 90.01 percent methane, about 5.99 percent ethane and about 4.00 percent propane, also purchased from Matheson Gas Products.

Hydrate formation is followed by the temperatures, pressures and mass flows continuously displayed and recorded on a computer and data acquisition system from Omega Engineering, Inc. A model FMA-8508 mass gas flow meter from Omega is used to measure gas added to the cell during hydrate formation. The flow meter has a capability of about 0–5000 sccm at an accuracy with 1 percent of full scale and a repeatability of within about 0.25 percent of flow rate. A Tescom Corporation model 26-1026 constant pressure regulator is used to maintain constant pressure in the cell within about ±6.9 kPa. During the runs, the inside of the cell is observed on a television monitor.

Comparative Example 1

Hydrate Growth

A quiescent water-gas system is formed by pumping about 2500 ml double-distilled water into the empty test cell to displace any gases therein and then injecting ethane under pressure into the cell to displace the water to a predetermined level. The initial pressure in the cell is about 2.41 MPa (350 psi). The temperature is adjusted to about 277.6 K (40° F.). The inside of the cell is observed on a television monitor. Gas hydrates form slowly in a random pattern of crystals, while a thin film of hydrates forms over the stagnant water surface.

Figure 2:
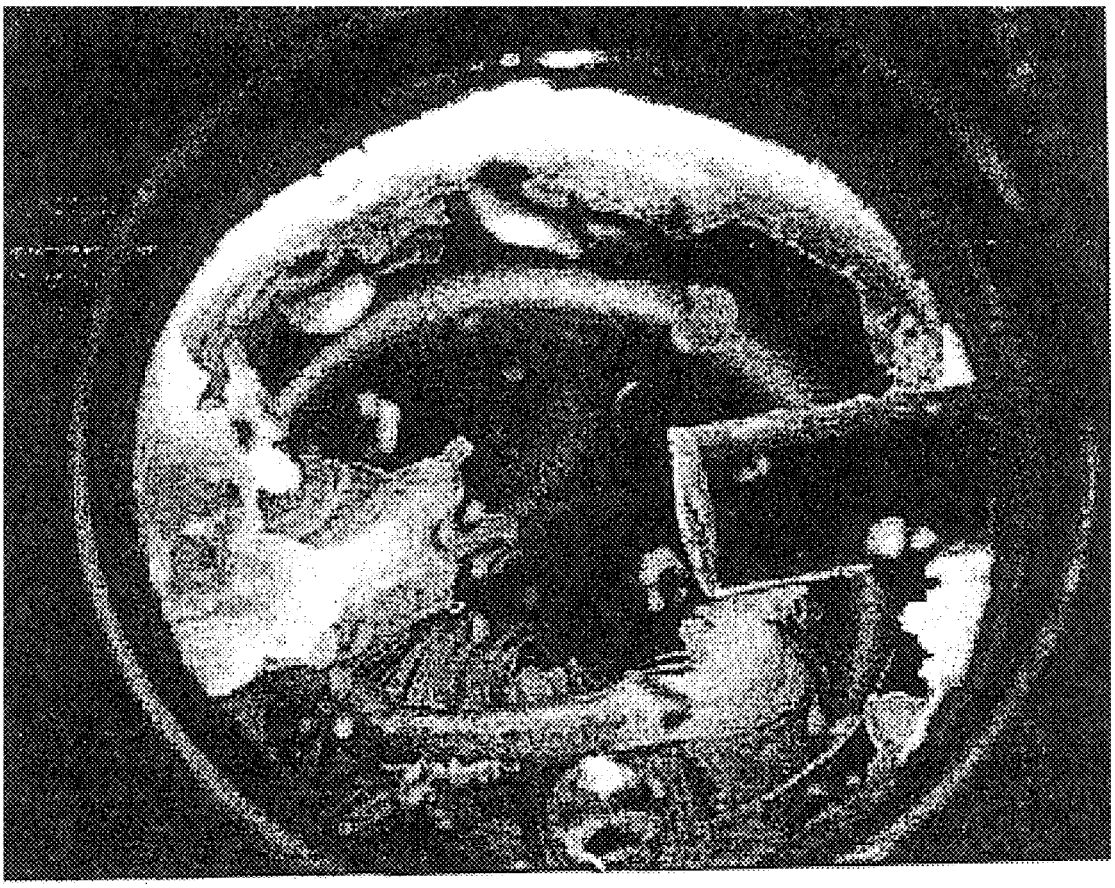
FIG. 2 is a photograph showing the growth of hydrate particles in a pure water-ethane system after one and a half days.
Figure 3:
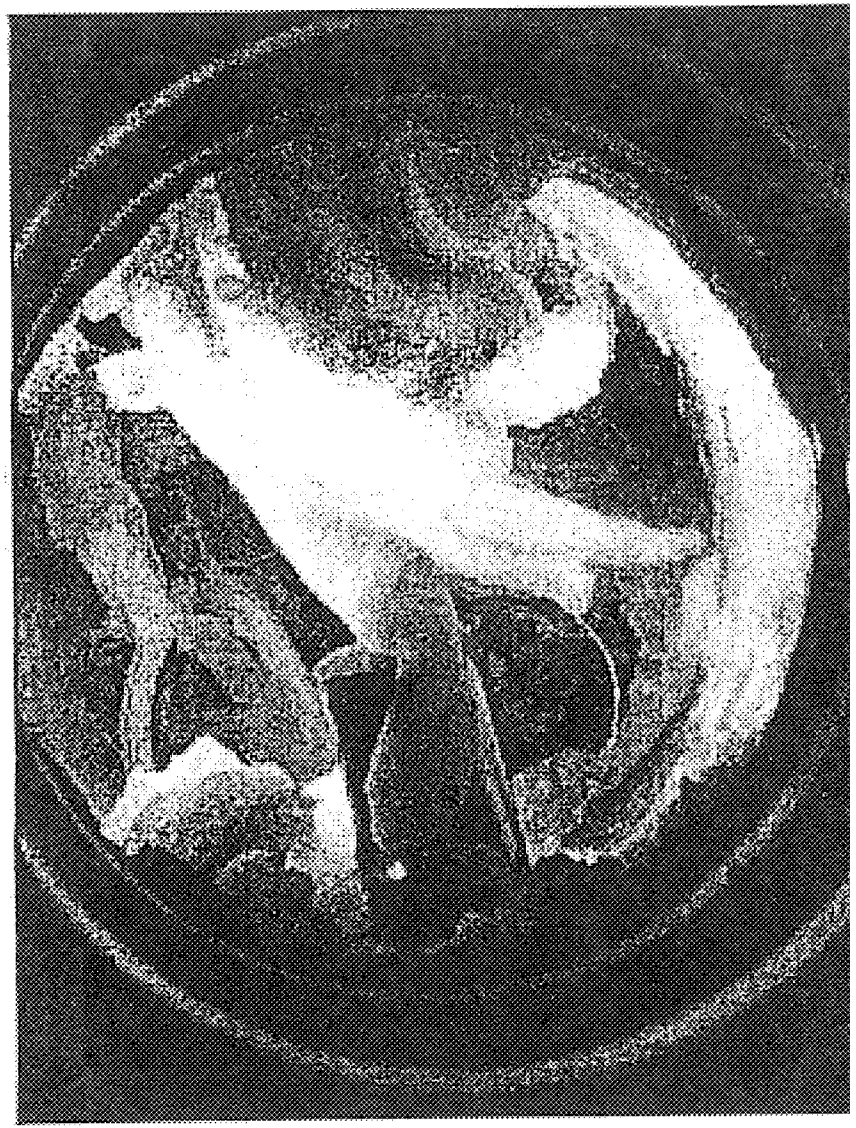
FIG. 3 is a photograph showing the growth of hydrate particles in a pure water-ethane system after five days.

FIGS. 2 and 3 are photographs of the crystal structure taken through the transparent quartz top of the pressurized cell a still camera. FIG. 2 shows crystal development about one and a half days after hydrate initiation. As can be seen, a random growth of crystals generally extends from one cold metal surface to another. The growth is not associated with any cell wall surface. The darker mass seen at the bottom of the storage cell is free water covered by a thin film of hydrates.

The same set of ethane-pure water crystals after five days is seen in FIG. 3. Even after five days, the crystals are still slowly extending their random growth. As the hydrate particles grow, their packing is not such that the space in the storage cell is efficiently used. To utilize hydrates in this form to store gas, several processing steps are necessary to crush and repack the solid hydrate mass while maintaining adequate temperature and pressure.

Example 1

Hydrate Growth

A quiescent water-surfactant-gas system is made by first combining about 2500 ml double distilled water and about 286 ppm sodium dodecyl sulfate to form a water-surfactant solution. The water-surfactant solution is pumped into the empty test cell to displace any gases therein. Ethane is then injected into the cell under pressure to displace the water-surfactant solution to a predetermined water level. The pressure of the test cell is about 2.31 MPa (335 psi). The temperature is adjusted to about 282 K (48° F.). The inside of the cell is observed on a television monitor. Gas hydrates develop rapidly outwardly from the walls toward the center of the cell in the shape of a concentric cylinder.

Figure 4:
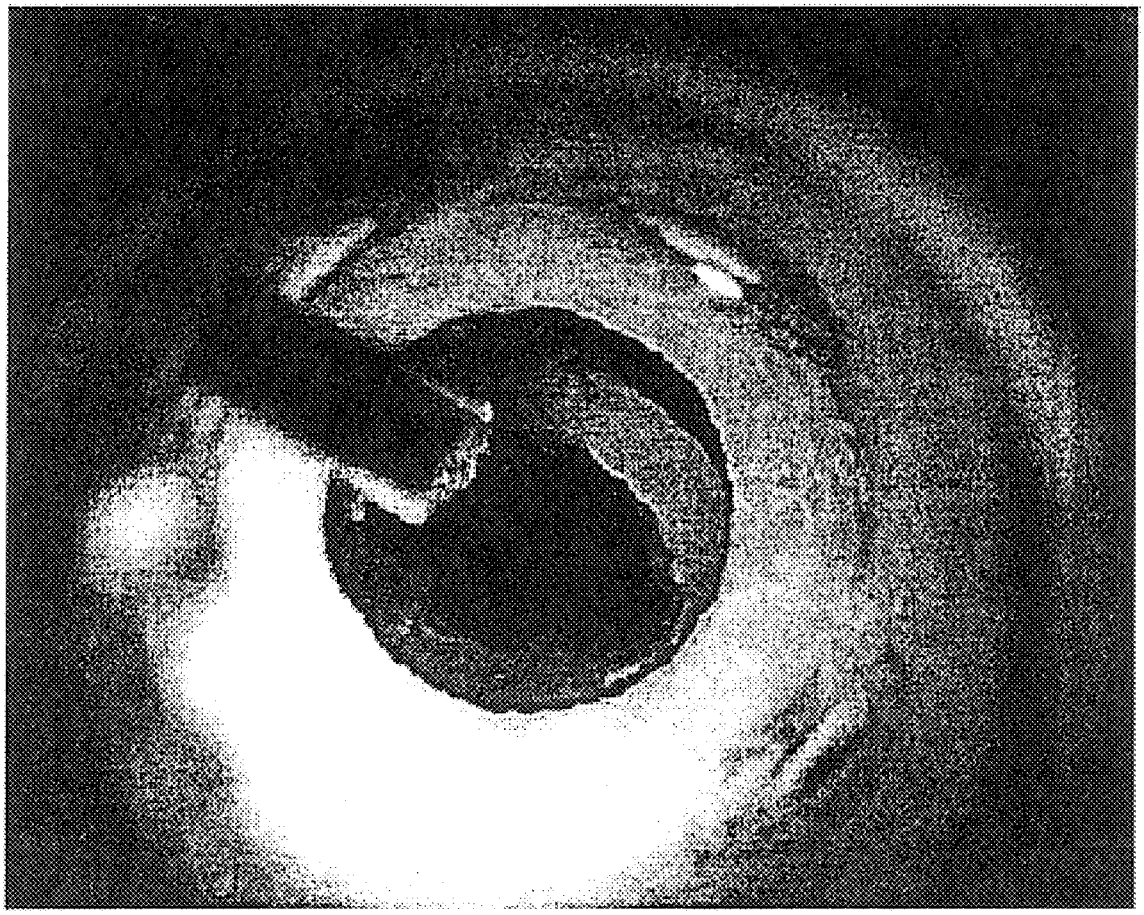
FIG. 4 is a photograph showing the growth of hydrate particles in a water-surfactant-ethane system after six and a half minutes.

FIG. 4 is a photograph of the crystal structure taken only six and a half minutes after the hydrate particles begin to form. As can be seen, the hydrate particles rapidly develop from the cell walls toward the center of the cell to form solid hydrate particle mass in the shape of a concentric cylinder. Also, as the water level in the cell drops during hydrate formation and the cooling coils become exposed in the bottom of the cell, hydrate particles then collect around that tubing.

Figure 5:
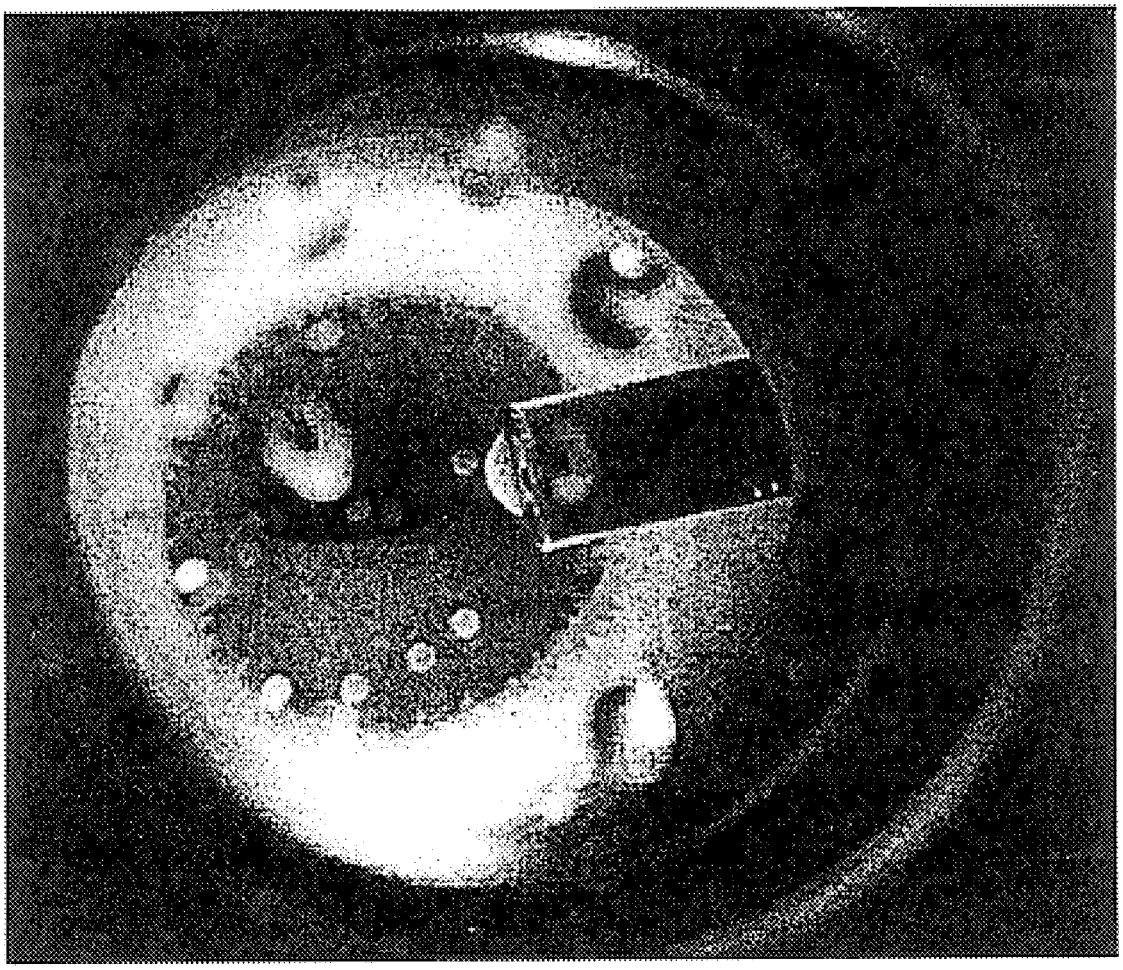
FIG. 5 is a photograph showing the growth of hydrate particles in a water-surfactant-ethane system after three and a half hours.

Hydrate formation in the water-surfactant-ethane system is allowed to continue until much more gas has been occluded. FIG. 5 is a photograph of the crystal development taken from the top into the test cell after about three and a half hours when equilibrium in the cell is established. FIG. 5 shows a concentric cylinder of hydrates around the wall of the cylinder with short multiple stalactite formations extending radially from the hydrate-shell surface. Also evident in FIG. 5 is that the base of the cylinder thickened around the tubing as the free water level dropped below the cooling coils. The small dark mass at the bottom center of the shell is the remaining free water. Water drops on the quartz window are also visible.

The denser packing seen in FIG. 5 indicates that the entrapped interstitial water converts to hydrates. When free water is depleted in the bottom of the cell, the water-surfactant solution trapped between hydrate particles on the cell walls continue forming hydrates. Hydrate formation from entrapped interstitial water, therefore, increases bulk density of hydrate packing and results in efficient packing for storage.

FIGS. 4 and 5 represent hydrates formed from ethane-water-surfactant systems, but similar behavior occurs in a natural gas-water-surfactant system where, again, the concentric cylinder of hydrates is observed.

The results of Example 1 and Comparative Example 1 indicate the effects of surfactant on hydrate growth. The stark difference in hydrate growth between the quiescent water-surfactant-gas system and the quiescent pure water-gas system can be seen from the photographs (FIGS. 2–5) taken of the inside of the test cell. Without surfactant (FIGS. 2 and 3), the hydrate particles grow slowly and in a random manner. The hydrate particles formed in surfactant solutions (FIGS. 4 and 5), on the other hand, create stable, concentric cylinders of solid hydrates growing rapidly inward from the cell walls.

The results of Example 1 and Comparative Example 1 also indicate the effects of surfactant on process simplification. Under similar conditions of temperature and pressure, different packings of hydrate particles occur. In the presence of surfactant, an improved means of hydrate particle collection is seen in that as the solid hydrate particles form, they pack on the cell walls and grow inwardly from the walls in the shape of a concentric cylinder. This packing arrangement of the hydrate particles formed from the surfactant-water system is more cost-efficient because no extra steps are necessary to remove the hydrates and repack them in a separate container for storage.

Comparative Example 2

Rate of Hydrate Formation

A quiescent water-gas system is formed by pumping about 2500 ml double-distilled water into the empty test cell to displace any gases therein and then injecting ethane under pressure into the cell to displace the water to a predetermined level. The pressure of the system is about 2.58 MPa (374 psi). The temperature is adjusted to about 274.8 K (35° F.). The hydrates form slowly. About 230 hours (about 10 days) after the induction period, only about 0.3 moles ethane/liter solution is occluded. Equilibrium of the occluded gas content is not approached even after 230 hours.

Example 2

Rate of Hydrate Formation

A quiescent water-surfactant-gas system is made by first combining about 2500 ml double distilled water and about 286 ppm sodium dodecyl sulfate to form a water-surfactant solution. The water-surfactant solution is pumped into the empty test cell to displace any gases therein. Ethane is then injected into the cell under pressure to displace the water-surfactant solution to a predetermined water level. Hydrates form quickly, and about 0.3 moles ethane/liter solution is occluded in about 20 minutes after the induction period. The occluded gas content approaches equilibrium in about 3 hours. Thus, a formation-decomposition cycle, including turnaround time, can be achieved within a 24-hour period.

Figure 6:
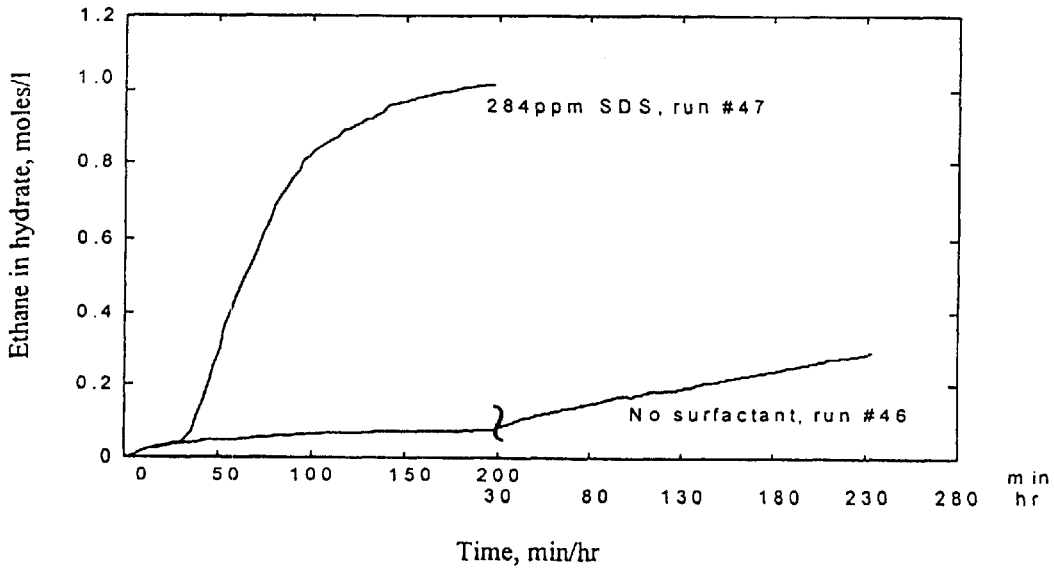
FIG. 6 is a graph showing the rate of hydrate particle formation.

The results of Comparative Example 2 indicate that hydrates form very slowly in a quiescent system of pure water and gas. The results of Example 2 indicates that, under like conditions, the addition of surfactant to the water increases the rate of hydrate formation in a quiescent system. FIG. 6 is a graph showing the hydrate formation rate with and without surfactant. In FIG. 6, hydration formation rate, as represented by the moles of ethane gas occluded per mole of water in the system, is plotted versus time after pressure and temperature have been brought to the hydrate formation conditions. As can be seen, after about 10 days, the system without surfactant is far from the hydrate capacity reached in less than 3 hours with a water-surfactant-gas system. The formation rate of hydrates in a quiescent water-gas system where surfactant is present is about 700 times faster than in a quiescent pure water-gas system. The rate increase of hydrate formation enhances the prospects of utilizing hydrates for gas storage because, with surfactant present, the hydrates form quickly in a simple, quiescent system thereby avoiding the need for mechanical stirring and the problems inherent with a mechanically-stirred system.

Figure 7:
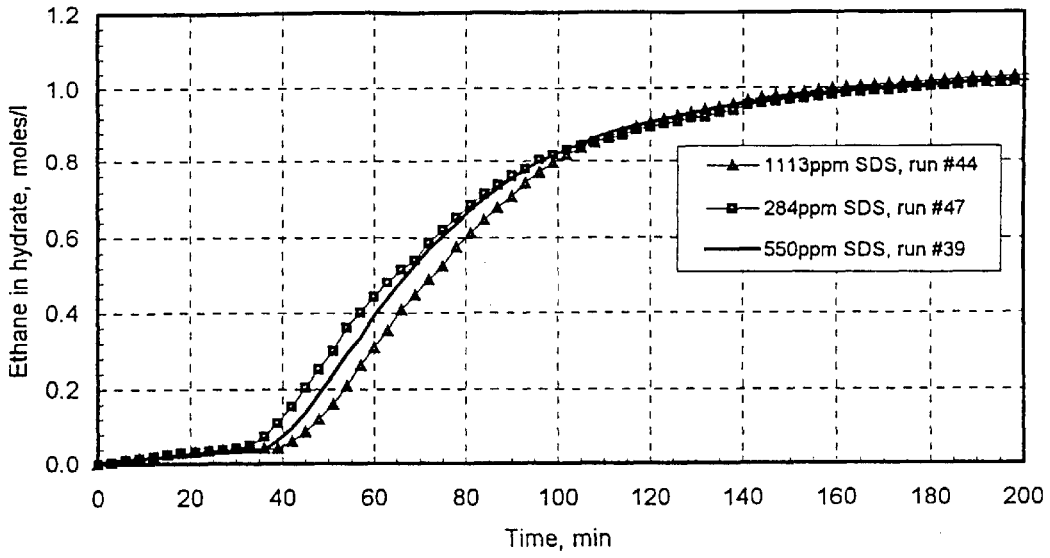
FIG. 7 is a graph showing the effects of surfactant concentration on hydrate particle formation.

A comparison of surfactant concentrations in the range of about 284 ppm to about 1113 ppm indicates that the rate of formation of the hydrates and the ultimate capacity of the hydrates for gas does not vary, but that the induction time, which is the time required for hydrate nuclei to reach the critical size for particle agglomeration, increases slightly from about 30 minutes to about 40 minutes in going from about 284 ppm to about 1113 ppm. FIG. 7 is a graph showing the effects of surfactant concentration on hydrate formation. Minor benefits of economy and convenience in using hydrates for gas storage, therefore, could be obtained using surfactant in the lower concentration ranges.

While not wishing to be bound, it is believed that above the critical micelle concentration, the solubility of the natural gas constituents is increased by accumulating the hydrocarbon molecules in the micelle where intimate contact with the surrounding water acts as nuclei and results in subsurface hydrate formation. Increased surfactant concentration above the critical micelle concentration does not appreciably affect the rate of formation but does slightly increase induction time.

Example 3

Conversion of Interstitial Water

Figure 8:
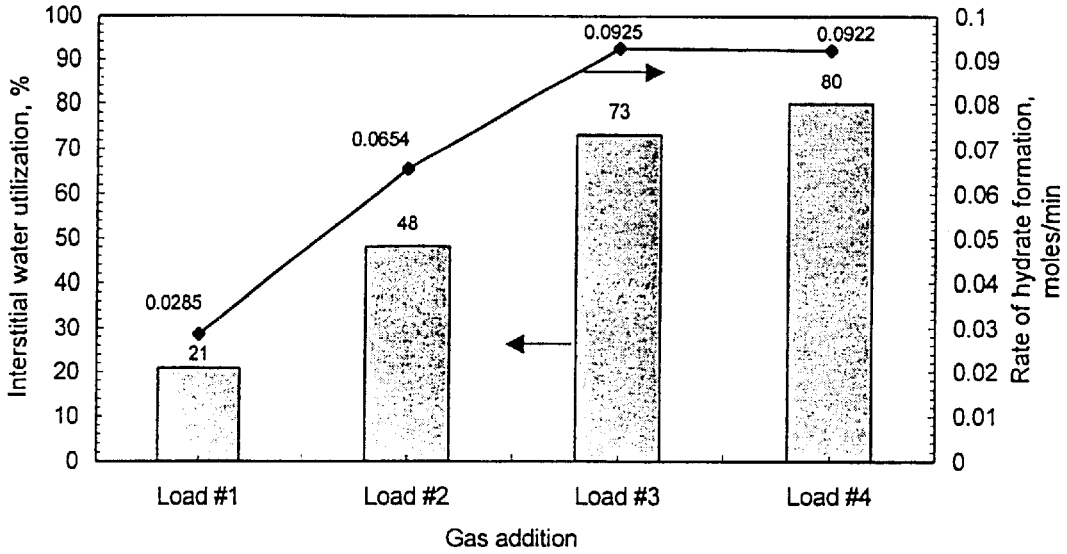
FIG. 8 is a graph showing the conversion of interstitial water and its hydrate formation rate according to the present invention.

A quiescent water-surfactant-gas system is made by first combining about 2500 ml double distilled water and about 286 ppm sodium dodecyl sulfate to form a water-surfactant solution. The water-surfactant solution is pumped into the empty test cell to displace any gases therein. Ethane is then injected into the cell under pressure to displace the water-surfactant to a predetermined water level. The initial pressure is about 2.61 MPa (379 psi). Hydrate particles form with attendant free water trapped between particles. The ethane gas E-15 above the stagnant water is allowed to approach equilibrium at about 0.78 MPa (113 psi) and about 276.5 K (38° F.), at which time the reaction is stopped and the unreacted free water is drained from the bottom of the cell using drain 35 depicted in FIG. 1. The cell is repressurized to about 2.61 MPa (379 psi) by adding another batch of ethane to the cell. The pressure is allowed to decline as more hydrates form. Three additional batch loadings of ethane are made, each time returning the pressure back to about 2.61 MPa (379 psi). FIG. 8 is a graph showing the conversion of interstitial water and its hydrate formation rate. As seen in FIG. 8, after the four loadings, approximately 80 percent of the interstitial water is within the hydrate structure.

The results of Example 3 indicate that the water trapped between hydrate particles in the cylindrical mass initially formed on the cell walls continues to form hydrates as additional gas is added to the cell. Because the unreacted free water in the bottom of the cell has been drained after the first loading of natural gas, any hydrate particles formed in subsequent loadings necessarily originated from water trapped between hydrate particles. It is noteworthy that the rate of hydrate formation for the interstitial water increased until about 70 percent of the interstitial water went into a hydrate structure. The rate increase is believed to be attributable to the increasing water-gas interfacial area as discrete hydrate particles form and contribute more surface area. After about 70 percent of the interstitial water is utilized, the formation rate no longer increased. This is believed to be attributable to the reduced permeability of the hydrate mass. With surfactant present in the water, it is apparent that water trapped between hydrate particles readily forms hydrates at a rapid rate. The importance of this result is that if hydrates are to be used for bulk natural gas storage, the free water trapped between particles can also be fully utilized simply by the addition of surfactant to the water-gas system, thereby increasing the gas packing fraction and optimizing storage space.

Having now fully described the invention, it will be apparent to one of ordinary skill in the art that many changes and modifications can be made thereto without departing from the spirit or scope of the invention as set forth herein.

What is claimed is:

1. A method of storing gas comprising:

forming a water-surfactant solution comprising water and an effective amount of surfactant;

adding to said solution a non-hydrocarbon gas under pressure, wherein said gas is capable of forming gas hydrates;

cooling said solution and said gas until a temperature for formation of gas hydrates is reached; and forming gas hydrates in the presence of the water-surfactant solution.

2. The method of claim 1, wherein the non-hydrocarbon gas is selected from the group consisting of carbon dioxide, sulfur dioxide, nitrogen, hydrogen sulfide and mixtures thereof.

3. The method of claim 1 wherein the surfactant is a biosurfactant.

4. The method of claim 1, wherein the surfactant is an anionic surfactant.

5. The method of claim 4, wherein the anionic surfactant is selected from the group consisting of alkyl sulfates, alkyl ether sulfates, alkyl sulfonates and alkyl aryl sulfonates.

6. The method of claim 5, wherein the anionic surfactant is an alkyl sulfate.

7. The method of claim 6, wherein the alkyl sulfate is sodium lauryl sulfate.

8. The method of claim 1, wherein the effective amount of surfactant is the critical micelle concentration of the surfactant.

9. The method of claim 1, wherein the surfactant is present in an amount from about 200 ppm to about 1200 ppm.

10. The method of claim 9, wherein the surfactant is present in an amount of from about 240 ppm to about 1120 ppm.

11. A method of promoting the formation of hydrates, comprising the steps of:

forming a solution comprising water and an effective amount of a surfactant;

adding to said solution a non-hydrocarbon gas under a pressure;

cooling said solution and said gas until a temperature for formation of gas hydrates is reached.

12. The method of claim 11, wherein the non-hydrocarbon gas is selected from the group consisting of carbon dioxide, sulfur dioxide, nitrogen, hydrogen sulfide and mixtures thereof.

13. The method of claim 11, wherein the surfactant is a biosurfactant.

14. The method of claim 11, wherein the surfactant is an anionic surfactant.

15. The method of claim 14, wherein the anionic surfactant is selected from the group consisting of alkyl sulfates, alkyl ether sulfates, alkyl sulfonates and alkyl aryl sulfonates.

16. The method of claim 15, wherein the anionic surfactant is an alkyl sulfate.

17. The method of claim 16, wherein the alkyl sulfate is sodium lauryl sulfate.

18. The method of claim 11, wherein the effective amount of surfactant is the critical micelle concentration of the surfactant.

19. The method of claim 11, wherein the surfactant is present in an amount from about 200 ppm to about 1200 ppm.

20. A composition for promoting gas hydrate formation comprising a mixture of water, an effective amount of a surfactant and at least one hydrate-forming constituent, wherein said at least one hydrate-forming constituent is a non-hydrocarbon gas.

21. The composition of claim 20, wherein the non-hydrocarbon gas is selected from the group consisting of carbon dioxide, sulfur dioxide, nitrogen, hydrogen sulfide and mixtures thereof.

22. An apparatus for forming and storing gas hydrates, comprising:

a container for holding a mixture of water, surfactant and at least one hydrate-forming constituent under pressure;

a first inlet for adding said at least one hydrate-form constituent to said container under pressure;

a second inlet for adding water and surfactant to said container under pressure;

first coils adapted to circulate a fluid in contact with said container; and at least a first coolant means for cooling said fluid to thereby cool said mixture below a temperature where, at least some of said water, surfactant and at least one hydrate-forming constituent within said container combine to form a solid hydrate.

23. The apparatus of claim 22, wherein said container is a metal container.

24. The apparatus of claim 23, wherein said metal container is stainless steel.

25. The method of claim 20, wherein the surfactant is present in an amount of from about 240 ppm to about 1120 ppm.

26. The composition of claim 20, wherein the surfactant is a biosurfactant.

27. The composition of claim 20, wherein the surfactant is an anionic surfactant.

28. The composition of claim 27, wherein the anionic surfactant is selected from the group consisting of alkyl sulfates, alkyl ether sulfates, alkyl sulfonates and alkyl aryl sulfonates.

29. The composition of claim 28, wherein the anionic surfactant is an alkyl sulfate.

30. The composition of claim 29, wherein the alkyl sulfate is sodium lauryl sulfate.

31. The composition of claim 20, wherein the effective amount of surfactant is the critical micelle concentration of the surfactant.

32. The composition of claim 20, wherein the surfactant is present in an amount from about 200 ppm to about 1200 ppm.

33. The composition of claim 32, wherein the surfactant is present in an amount of from about 240 ppm to about 1120 ppm.

* * * * *